US008591294B2

(12) United States Patent
Rieser

(10) Patent No.: US 8,591,294 B2
(45) Date of Patent: Nov. 26, 2013

(54) SHARPENING ROD AND METHOD FOR MANUFACTURING THE SAME

(75) Inventor: Udo Rieser, Bingen am Rhein (DE)

(73) Assignee: High Tech Ceramic EK (DE)

( * ) Notice: Subject to any disclaimer, the term of this patent is extended or adjusted under 35 U.S.C. 154(b) by 1009 days.

(21) Appl. No.: 12/506,507

(22) Filed: Jul. 21, 2009

(65) Prior Publication Data

US 2010/0018352 A1 Jan. 28, 2010

(30) Foreign Application Priority Data

Jul. 24, 2008 (EP) ..... 08013367

(51) Int. Cl.
*B23F 21/03* (2006.01)

(52) U.S. Cl.
USPC ..... 451/461; 451/552; 451/557

(58) Field of Classification Search
USPC ..... 451/461, 552, 555, 556, 557
See application file for complete search history.

(56) References Cited

U.S. PATENT DOCUMENTS

| | | | | |
|---|---|---|---|---|
| 1,352,888 | A * | 9/1920 | Gallagher | 76/84 |
| 2,380,539 | A * | 7/1945 | Miller | 451/557 |
| 4,759,153 | A * | 7/1988 | Cohen | 451/45 |
| 5,172,523 | A * | 12/1992 | Kadlec | 451/540 |
| 5,564,973 | A * | 10/1996 | Salvail | 451/540 |
| 6,059,645 | A * | 5/2000 | LeVine | 451/557 |
| 6,168,509 | B1 * | 1/2001 | Presgrove | 451/552 |
| 7,172,500 | B1 * | 2/2007 | Wu et al. | 451/319 |
| 8,020,473 | B2 * | 9/2011 | Tsai | 81/490 |
| 8,221,199 | B2 * | 7/2012 | Smith | 451/552 |
| 2001/0001757 | A1 * | 5/2001 | Gunn | 451/557 |
| 2008/0166959 | A1 * | 7/2008 | Williams | 451/552 |
| 2011/0159791 | A1 * | 6/2011 | Heng | 451/371 |

FOREIGN PATENT DOCUMENTS

| | | |
|---|---|---|
| CH | 321224 | 4/1957 |
| EP | 0325857 | 8/1989 |

OTHER PUBLICATIONS

Search Report; Application No. EP 08013367; 2 pages mailed Oct. 18, 2008.

* cited by examiner

*Primary Examiner* — Eileen P. Morgan
(74) *Attorney, Agent, or Firm* — Thomas & Karceski, P.C.

(57) ABSTRACT

In a sharpening rod with a peripheral surface which constitutes a sharpening surface, wherein the sharpening rod (1) is formed of a material with specified grain size, the peripheral surface includes at least two pairs (2, 3) of sharpening surfaces (2*a*, 2*b*, 3*a*, 3*b*) of different materials, which sharpening surfaces of each pair are located opposite each other transverse to the longitudinal direction of the rod, wherein the pairs (2, 3) of sharpening surfaces are arranged offset with respect to each other in peripheral direction of the sharpening rod (1) and a first one (2) of the pairs (2, 3) of sharpening surfaces is formed of a first material with a first grain size and the at least second pair (3) of sharpening surfaces is formed of a second material with a second grain size. Furthermore, there is proposed a method for manufacturing such sharpening rod (1).

6 Claims, 3 Drawing Sheets

SHARPENING ROD AND METHOD FOR MANUFACTURING THE SAME

This invention relates to a sharpening rod or whetrod with a peripheral surface which constitutes a sharpening surface, wherein the sharpening rod is formed of a material with a specified grain size. This invention relates to a method for manufacturing such sharpening rods.

Sharpening rods are used for sharpening of cutting tools, in particular knives. The material of the sharpening rods has a corresponding grain size depending on the requirement. For instance, sharpening rods with a coarser grain are used for rough grinding with a lower degree of sharpness, and sharpening rods with a fine grain are produced for fine grinding with a high degree of sharpness. Known sharpening rods are made for instance of alumina ceramics. In ceramic sharpening rods, a rather coarse standard grain for instance corresponds to corundum of grain size 360 and a very fine standard grain approximately corresponds to corundum of grain size 1000. With such extremely fine sharpening rods, razor blade grinding can be achieved. The user usually first sharpens the tool with a coarse sharpening rod. In doing so, the user alternately is drawing the tool along the sharpening rod at an upper and at a lower edge thereof. If also a fine sharpening rod is available, the user will change the sharpening rod and finely hone his tool with the same. However, this working step frequently is omitted, as a fine sharpening rod is not available.

There are also known sharpening rods which in opposite regions of the peripheral surface each have a plurality of parallel longitudinal grooves, in order to increase the roughness in these regions and thus form two different roughnesses on one sharpening rod. However, the results were not satisfactory when sharpening the tools.

Therefore, the object of the invention is to improve a generic sharpening rod such that tools can be sharpened therewith more effectively in a simple way. Furthermore, a method should be proposed, by which such sharpening rods can be manufactured at low cost.

In accordance with the invention, this object is achieved by a sharpening rod (whetrod) as mentioned above in that the peripheral surface includes at least two pairs of sharpening surfaces of different materials, the sharpening surfaces of each pair being located opposite each other transverse to the longitudinal direction of the rod, wherein the pairs of sharpening surfaces are arranged offset with respect to each other in peripheral direction of the sharpening rod, and a first one of the pairs of sharpening surfaces is formed of a first material with a first grain size and the at least one second pair of sharpening surfaces is formed of a second material with a second grain size.

With a sharpening rod of the invention, tools can be sharpened quickly and effectively. Due to the fact that the sharpening rod is composed of different materials, sharpening surfaces for ground sections with different degrees of fineness can be formed in only one sharpening rod. The user initially can use the two opposed coarser sharpening surfaces and then slightly rotate the sharpening rod about its longitudinal axis, e.g. by 45° to 90°, and then immediately finely hone the tool on a second pair of sharpening surfaces with opposed finer sharpening surfaces. Since the different degrees of fineness are formed by different materials, the corresponding optimum materials can be employed for the respective degrees of fineness, so that even further essential material characteristics, such as wear resistance, are optimally adjustable.

Preferably, the sharpening rod includes at least three partial rods extending one beside the other and parallel to each other, which are connected with each other and at least two partial rods of which are formed of the first material and at least one partial rod of which is formed of the second material, wherein two partial rods of the same material form a pair of sharpening surfaces. In a sharpening rod composed of partial rods, the sharpening surfaces of different materials can be formed by partial rods of different materials in a very simple way. The manufacturing effort for sharpening rods of the invention thereby is reduced considerably, since the partial rods can be prefabricated individually.

Preferably, the sharpening rod includes three partial rods, one of which constitutes a center rod which is formed of the second material, the two other partial rods constitute two outer rods, which are formed of the first material and are mounted on two opposite sides of the center rod. With these measures, the manufacture of a sharpening rod of the invention can further be simplified, since a pair of sharpening surfaces is formed by merely joining two outer rods to two opposite sides of the center rod.

Preferably the outer rods fully rest against the center rod in the region of contact with the same, so that the compressive stresses extend rather uniformly.

On the two opposite sides, the center rod advantageously each has a groove extending in longitudinal direction of the rod, in which one outer rod each is embedded. Due to this measure, the outer rods automatically are guided into their desired position relative to the center rod, because they are inserted in the respective groove, which substantially simplifies manufacture. In addition, the grooves provide the outer rods with lateral support during usage, so that due to contact with the groove walls, lateral forces acting on the outer rods are passed on into the center rod, which distinctly increases the durability of the connection between outer rod and center rod and the magnitude of the lateral forces to be absorbed.

In an advantageous aspect of the invention, the outer rods have a cross-section with a convex outer surface, and the grooves have a correspondingly concave cross-section for accommodating an outer rod, in particular free from clearance. The manufacturing effort thereby is distinctly reduced, in particular when the outer rods have a circular cross-section and the grooves have a corresponding part of a circle as cross-section.

Advantageously, each outer rod should fully rest against the wall of the groove.

It is also conceivable that the outer rods each have a depression extending in longitudinal direction of the rod, in which the center rod rests with a convex surface portion. Thus, the outer rods might for instance be crescent-shaped and the center rod might have a circular cross-section.

The entire outer contour of the sharpening rod preverably is oval-shaped in cross-section. Particularly preferably, the outer rods each are arranged at a narrow end of the oval.

In a further preferred embodiment of the invention, the sharpening rod is formed of four partial rods extending one beside the other and parallel to each other, two of which each are formed of the same material and are located opposite each other in cross-section, in order to form the pairs of sharpening surfaces.

It is conceivable, for instance, that these partial rods are quarter rods, which each have a quarter-circle cross-section. The quarter rods each located opposite each other are made of the same material. On their radial surfaces, the quarter rods are attached to each other.

In a favorable development of the invention, all materials are alumina ceramics, wherein the first grain corresponds to corundum of grain size 200 to 700, preferably corundum of grain size 250 to 500, and quite particularly preferably corundum of grain size 300 to 400, and the at least second grain corresponds to corundum of grain size 800 to 1200, preferably corundum of grain size 900 to 1100, and quite particularly preferably corundum of grain size 950 to 1050. Such materials on the one hand are extremely wear-resistant and on the other hand very precisely adjustable in their degree of fineness.

Advantageously, the outer rods are formed of alumina ceramics with the first grain, and the center rod is formed of a compression molding compound of pure alumina, which corresponds to the second grain.

In an advantageous embodiment of the invention, the partial rods are connected with each other by glaze. Glaze has an extremely high adhesive force and forms a high-strength connection between the partial rods which can be produced at low cost.

In accordance with the invention, there is also proposed a method for manufacturing a sharpening rod.

With the method of the invention, sharpening rods can be made of two different materials each in a reliable and inexpensive way. Since at least two partial rods on the one hand and at least one partial rod on the other hand are made of different ceramic materials and all partial rods are fired as individual rods at a first firing temperature, all partial rods on the one hand form extremely effective and wear-resistant grinding surfaces due to the fired ceramic material, wherein on the other hand the different shrinkages of the different ceramic materials during firing are of no importance due to firing as individual rods. Since all partial rods are made of ceramic material, the partial rods also can extremely firmly be connected with each other in a simple way by means of a glaze whose melting temperature lies below the first firing temperature. For this purpose, from among those contact surfaces where the partial rods rest against each other, at least the contact surface of one of the partial rods each resting against each other is coated with glaze components whose melting temperature lies below the first firing temperature. The partial rods then are placed against each other and fixed in their position. Subsequently, the joined rods are fired at a second firing temperature, which is at least as high as the melting temperature and lies below the first firing temperature. Connecting the ceramic partial rods by means of a glaze by firing the ceramic partial rods a second time at the described second firing temperature produces an extremely high-strength connection of the partial ceramic rods with each other in a simple way, since during firing the liquid glaze flows into the depressions in the surface of the ceramic rods and thus high connecting forces are produced in the cold condition.

In a favorable development of the invention, steps a) to f) are configured as indicated, and the method furthermore comprises steps g) to j). With these measures, the costs of manufacturing sharpening rods of the invention can be reduced even further, while maintaining the quality of the finished product. Due to the fact that in steps d) to f) only one outer rod initially is connected with the center rod, wherein the center rod is placed on a groove and a first outer rod is inserted in the opposite, upper (first) groove and glazed to the center rod, separately holding and fixing the outer rod in this groove is not necessary. Holding and fixing the outer rod rather is effected merely by its vertical arrangement in the horizontally extending groove. Only thereafter is the second outer rod inserted in the still unoccupied second groove of the center rod and glazed to the same in a further firing operation. For this purpose, the center rod and the first outer rod glazed to the same are rotated by 180° about the longitudinal axis of the rod and placed on the first outer rod. For glazing the second outer rod to the center rod, a different glaze is used than in the preceding firing operation. The melting temperature of this other, second glaze lies below the melting temperature of the first glaze. Due to the fact that the firing temperature of the third firing operation is at least as high as this second melting temperature, but lies below the second firing temperature, the second outer rod is glazed to, i.e. firmly connected with the center rod, without the glaze between the first outer rod and the center rod being softened and their firm connection being loosened in this way.

The support on which the center rod with the adjoined outer rods is placed for the respective firing operation is completely flat, so that during the firing operations no deviations in terms of straightness are introduced into the partial rods or the finished sharpening rod. Quite to the contrary, deviations from straightness possibly existing in partial rods largely are eliminated by the completely flat support, which also is referred to as firing plate, since the ceramic material is also slightly softened below its own firing temperature (step c)) and as a result possibly existing small deviations from straightness will disappear.

Preferably, a vertical compressive force is applied onto the center rods and the inserted outer rods from above during the firing operation. Due to this compressive force, the outer rods are pressed even more into the grooves of the center rod.

The center rods with the outer rods can be fired in several layers one above the other, wherein a second firing plate is placed onto the first layer, on which a second layer of center rods with outer rods is placed, on which in turn a further firing plate with a further layer of rods is placed, and so on. The compressive force is exerted by the respective upper layers onto the respective bottom layers. Onto the uppermost layer a last firing plate without a further layer of rods can be placed, in order to produce a minimum compressive force for the uppermost layer.

Preferably, the first ceramic material is an alumina ceramic with corundum in the range from 200 to 700, preferably 250 to 500, and quite particularly preferably in the range from 300 to 400.

Preferably, the second ceramic material is a pure alumina compression molding compound, which corresponds to a grain or corundum in the range from 800 to 1200, preferably in the range from 900 to 1100, and quite particularly preferably in the range from 950 to 1050.

With these grains, tools can effectively be sharpened or finely honed. On the other hand, these materials are very suitable for the method of the invention, since the temperature behavior of these ceramic materials is very well adjustable and it can therefore be ensured that no unexpected changes of the material properties occur at the different firing temperatures of the different firing operations.

Preferably the first firing temperature is at least 1350° C., particularly preferably at least 1450° C., the first melting temperature is 900 to 1300° C., particularly preferably 950 to 1050° C., and the possibly second melting temperature is 600° C. to 850° C., particularly preferably 750 to 850° C. As a result, the firing operations on the one hand can be performed extremely economically, and on the other hand extremely high-quality sharpening rods with a long useful life are obtained.

In a preferred embodiment of the invention, the individual rods are fired in step c) in a roller kiln, where during firing the individual rods slowly roll through tubes, so that they are rolled straight.

The invention will subsequently be explained in detail by way of example with reference to the drawings, in which.

The embodiments shown in the Figures of sharpening rods (whetrods) 1 of the invention each include two pairs 2, 3 of sharpening surfaces 2*a*, 2*b*, 3*a*, 3*b* or sharpening regions each located opposite each other transverse to the longitudinal direction of the rods. The pairs 2, 3 of sharpening surfaces are arranged offset with respect to each other in peripheral direction of the sharpening rods 1.

Figure 1:
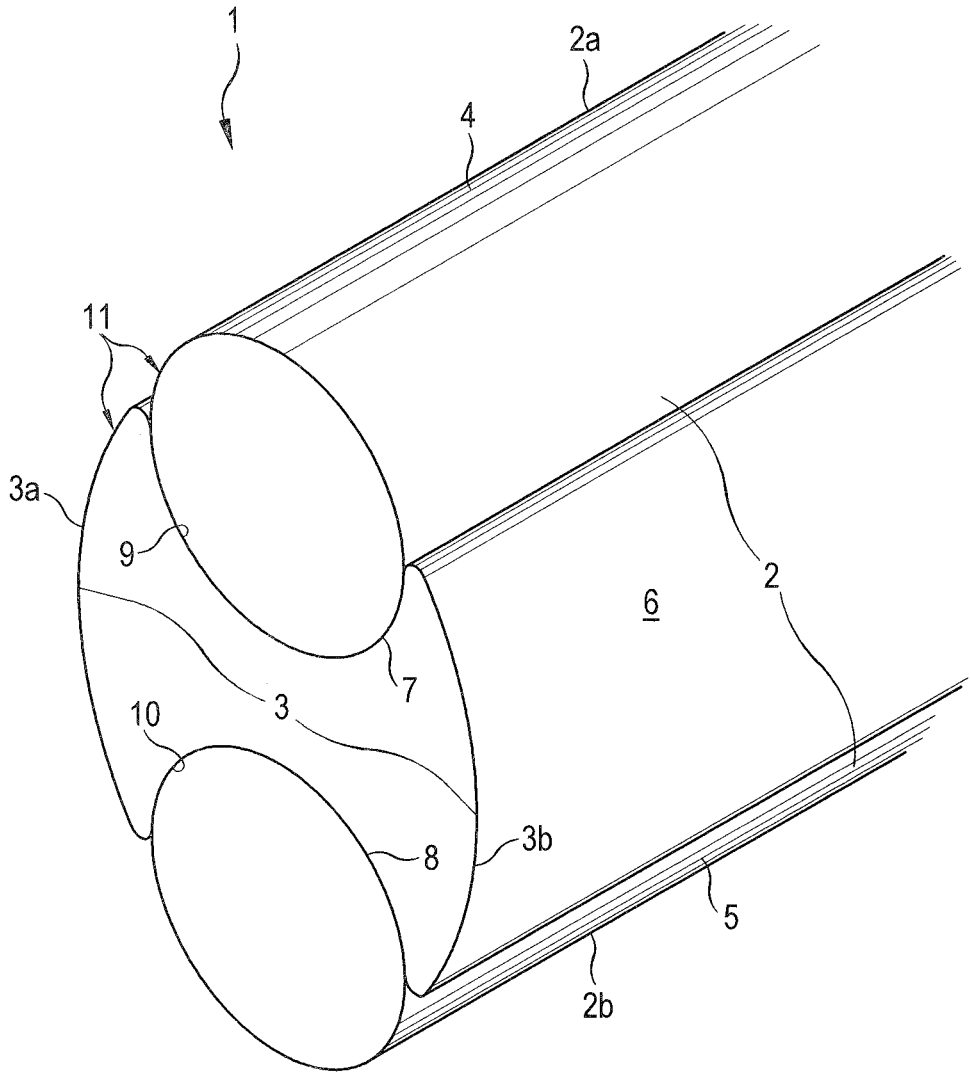
FIG. 1 shows a perspective partial view of a first embodiment of a sharpening rod in accordance with the invention.
Figure 2:
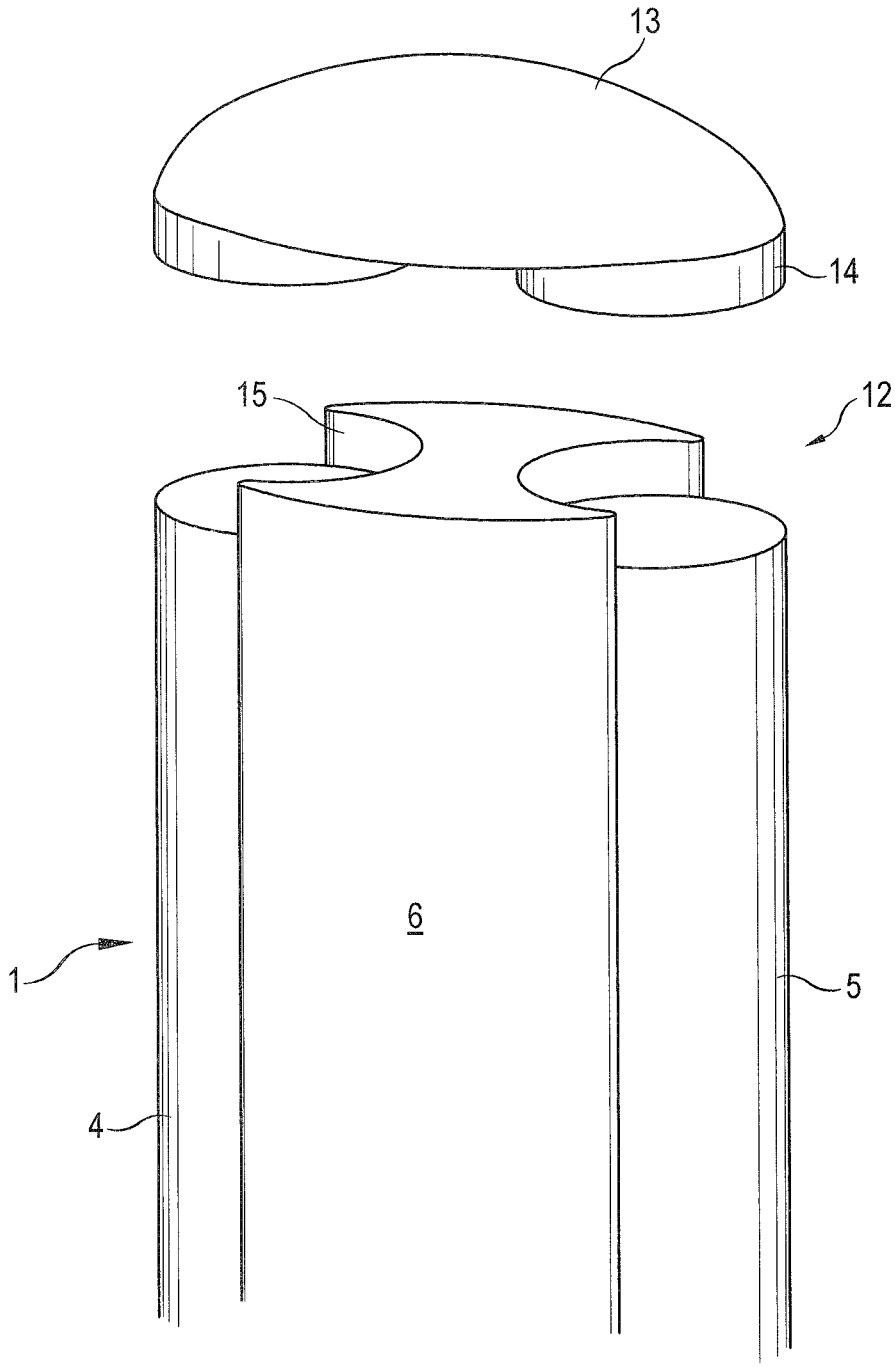
FIG. 2 shows a top view of an end of the sharpening rod of FIG. 1 with an end cap in a perspective exploded representation.
Figure 3:
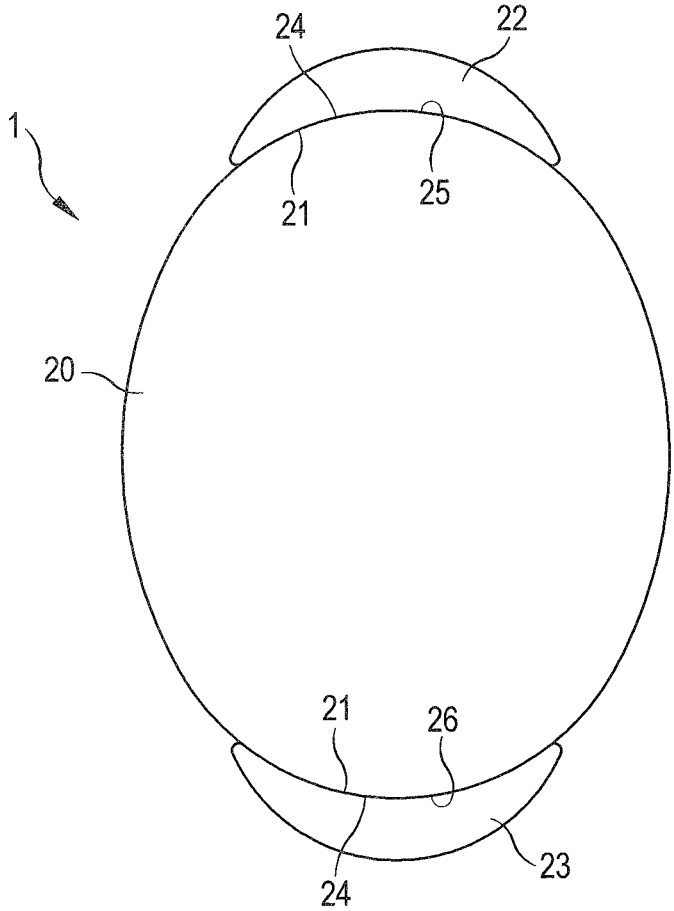
FIG. 3 shows a cross-sectional view of a second embodiment of a sharpening rod in accordance with the invention.

The embodiments represented in FIGS. 1 to 3 show sharpening rods 1 which are each made of three partial rods 4, 5, 6. One of the partial rods forms a center rod 6, on which the two other partial rods are mounted on opposite sides as outer rods 4, 5.

In the embodiment shown in FIGS. 1 and 2, the two outer rods 4, 5 constitute round rods, i.e. with a circular cross-section. They have a diameter of 7 mm. The center rod 6 includes two opposed grooves 7, 8, which each have a cross-section in the form of a part of a circle. The radius of the pitch circule corresponds to the radius of the circular cross-section of the round rods 4, 5 and is 3.5 mm in the present case, so that the round rods 4, 5 can be inserted in the grooves 7, 8 without clearance. The indicated dimensions do not yet consider any suitable fitting and manufacturing tolerances.

Offset by 90° in peripheral direction with respect to the grooves 7, 8, the center rod 6 has two opposed convex outer surfaces 3*a*, 3*b*, which extend from groove to groove. These outer surfaces 3*a*, 3*b* likewise extend in the form of a part of a circle, wherein the radius of each part of a circle is 9.5 mm, and the centers of the circle are offset with respect to each other such that the outer surfaces 3*a*, 3*b* approximately form the broad sides of an oval.

The combined total cross-section of the sharpening rod 1 approximately corresponds to an oval, wherein the two round rods 4, 5 each are arranged at the narrow ends of the oval.

The two round rods 4, 5 are made of alumina ceramics and contain corundum of grain size 360. The center rod 6 is a compression molding compound of pure alumina, which approximately corresponds to corundum of grain size 1000. The round rods 4, 5 are glazed to the center rod 6 by means of glazes 9, 10.

The free surfaces 2*a*, 2*b* of the opposed round rods 4, 5 form the one pair 2 of sharpening surfaces, whereas the opposed convex outer surfaces 3*a*, 3*b* of the center rod 6 form the second pair 3 of sharpening surfaces, which is offset by 90° with respect to the first one in peripheral direction of the sharpening rod 1.

At one end 11 of the sharpening rod 1, a handle (not shown) can be mounted. To the second end 12 of the sharpening rod 1 an end cap 13 is glazed. It is likewise formed of alumina ceramics, in the present case as a compression molded ceramic part of the same material as the center rod 6.

At this second end 12 of the sharpening rod 1, the ends of the round rods 4, 5 are set back by a predetermined amount with respect to the end of the center rod 6. The end cap 13 includes two corresponding protrusions or pins 14, which engage in these offsets or shoulders 15. The height of the shoulder 15 and the protrusions or pins 14 is 1-2 mm. In this way, it is prevented that the end cap 13 slips with respect to the rod when being glazed.

The two materials of the sharpening rod 1, i.e. the round rods 4, 5 on the one hand and the center rod 6 on the other hand, can be colored differently, in order to facilitate handling for the user.

Such sharpening rod 1 is manufactured as follows:

First, the partial rods 4, 5, 6 are extrusion molded from the respective ceramic material. Then, all three partial rods 4, 5, 6 are fired individually in a roller kiln at a temperature of at least 1450° C. During firing, the partial rods 4, 5, 6 slowly roll through tubes, so that they are rolled straight. Since the partial rods 4, 5, 6 are fired in the condition not yet joined, disadvantageous effects caused by the different shrinkages of the different ceramic materials can be avoided during firing.

After this first firing operation, a second and a third firing operation are performed in conventional glazing kilns. For the second firing operation, the center rod 6 with a groove 8 is placed on a completely flat firing plate. In the opposed, upper groove 7, glaze 9 or a mixture with glaze components is spread, whose melting temperature is about 1000° C., and then one of the round rods 4 is inserted. It is also possible that several layers of center rods 6 with inserted round rods 4 are fired in this firing operation. For this purpose, a new firing plate can be placed on the first layer of center rods/round rods 6/4 and in turn center rods 6 with a groove 8 can be placed on the same, and so on. The weight of the upper layers then presses the round rod 4 of the respectively bottom layers into the grooves 7 to a greater extent. It is conceivable that one more firing plate is placed onto the uppermost layer, in order to produce a compressive force for the round rods 4 of the uppermost layer, which presses the round rods 4 into the grooves 7.

The second firing operation then is performed at a second firing temperature of 1000° C., at which the components of the first glaze 9 melt and the first glaze 9 obtained connects the center rod 6 with the round rod 4.

For the third firing operation, the center rod 6 with the round rod 4 glazed thereto is rotated by 180°, so that the center rod 6 lies on the round rod 4 glazed thereto on the firing plate.

Then, the still unoccupied groove 8, which now lies on top, is coated with the components of a second glaze 10. This second glaze 10 has a melting temperature of about 800° C. The second round rod 5 is inserted in the groove 8. Like in the second firing operation, a plurality of layers possibly are arranged one above the other.

The third firing operation then is performed at 800° C., so that the first glaze 9, which has a melting temperature of about 1000° C., does not melt and thus does not run down along the lower round rod 4.

After this third firing operation, all three partial rods 4, 5, 6 are firmly connected with each other in the cold condition. By means of a diamond saw, they are then cut to the exact length.

When inserting the round rods 4, 5 in the grooves 7, 8, the round rods 4, 5 are set back at one end with respect to the center rod 6 by a specified amount, in order to form a shoulder 15 in which the pin 14 of an end cap 13 should then engage.

In the third firing operation, the end cap 13 can be glazed to the second end 12 of the sharpening rod 1 with the second glaze 10. For this purpose, the end cap 13 is held at the second end 12 by means of firing aids.

However, a fourth firing operation can for instance be performed. For a fourth firing operation, the sharpening rods 1 are placed on a firing plate with the flush cut-off end 11. The other end 12, which includes the shoulders 15, is coated with the components of a third glaze, whose melting point is about 600° C. Then, the end cap 13 is attached such that the pins 14 of the end cap 13 engage in the shoulders 15 between round rod 4, 5 and center rod 6.

Then, the fourth firing operation is performed at a fourth firing temperature of about 600° C., so that the components of the third glaze melt and the third glaze obtained connects the end cap 13 with the end 12 of the sharpening rod 1.

On the flush cut-off end 11 of the sharpening rod 1, a handle is now mounted and connected with the sharpening rod 1 in a conventional way.

In the embodiment shown in FIG. 3, the center rod 20 has no grooves, but in this region also has a convex surface 21, against which rests a concave surface 24 of outer rods 22, 23. The center rod 20 and the outer rods 22, 23 are made of the same ceramic materials as in the embodiment of FIGS. 1 and 2. Here as well, the connection between the center rod 20 and the outer rods 22, 23 is effected by means of a glaze 25, 26 corresponding to the embodiment described above.

Figure 4:
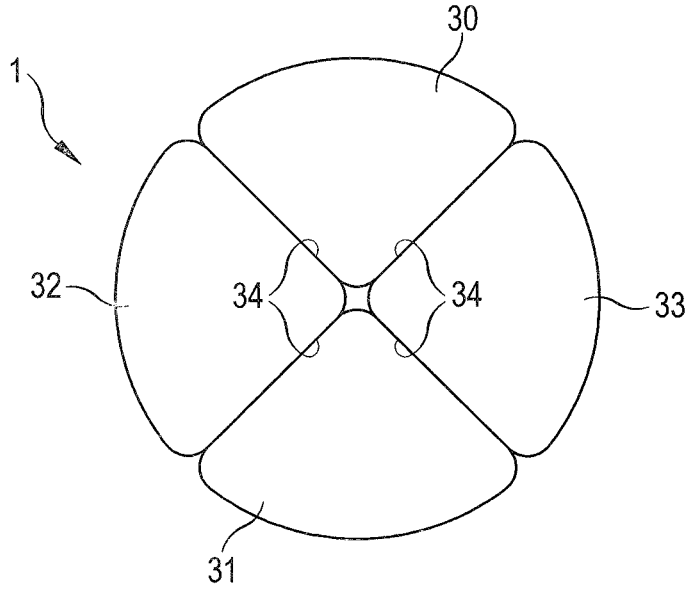
FIG. 4 shows a cross-sectional view of a third embodiment of a sharpening rod in accordance with the invention.

FIG. 4 shows an embodiment for a sharpening rod 1 composed of four partial rods 30, 31, 32, 33. The illustrated embodiment has a circular total cross-section, wherein the partial rods constitute quarter rods 30, 31, 32, 33, i.e. have a cross-section in the form of a quarter circle or quarter-circle sector. The connection between the quarter rods 30, 31, 32, 33 in turn is effected by means of glazes 34. The quarter rods 30, 31, 32, 33 located opposite each other each are formed of the same ceramic material and each form a pair 2, 3 of sharpening surfaces.

With non-circular total cross-sections of the complete sharpening rod 1, e.g. with an oval total cross-section, the four partial rods 30, 31, 32, 33 have corresponding sector-shaped cross-sections.

The partial rods 30, 31, 32, 33 need not necessarily extend each over a quarter of the circumference. Rather, the size of the sectors each can be adapted to the requirements.

The invention claimed is:

1. A sharpening rod assembly with a peripheral surface which constitutes a sharpening surface, wherein the sharpening rod assembly is formed of a material with a specified grain size, characterized in that the peripheral surface includes at least two pairs-of sharpening surfaces-made of different materials, which sharpening surfaces of each pair are located opposite each other transverse to the longitudinal direction of the rod, wherein the pairs of sharpening surfaces are arranged offset with respect to each other in peripheral direction of the sharpening rod and a first one of the pairs of sharpening surfaces is formed of a first material with a first grain size and the at least one second pair of sharpening surfaces is formed of a second material with a second grain size different from the first grain size; and characterized by the sharpening rod assembly consisting of three rods extending one beside the other and parallel to each other, each of the three rods having a length and a constant cross-section extending the entire length, wherein the three rods are connected with each other and one of which forms a center rod which is formed of the second material, and the two other rods form two outer rods which are formed of the first material and are mounted on two opposite sides of the center rod, the first and the second material being ceramic materials, and wherein the two outer rods form the first one of the pairs of sharpening surfaces and the center rod forms the center rod forms the at least one second pair of sharpening surfaces.

2. The sharpening rod assembly according to claim 1, characterized in that on the two opposite sides the center rod each has a groove-extending in longitudinal direction of the rod, in which an outer rod each is embedded.

3. The sharpening rod assembly according to claim 2, characterized in that the outer rods have a cross-section with a convex outer surface and the grooves have a correspondingly concave cross-section for accommodating an outer rod.

4. The sharpening rod assembly according to claim 1, characterized in that all materials are alumina ceramics.

5. The sharpening rod assembly according to claim 4, characterized in that the first grain corresponds to corundum of grain size 200 to 700 and the at least second grain corresponds to corundum of grain size 800 to 1200.

6. The sharpening rod assembly according to claim 1, characterized in that the rods are connected with each other by means of glaze.

* * * * *